United States Patent [19]

Tomoe

[11] Patent Number: 4,782,359

[45] Date of Patent: Nov. 1, 1988

[54] FIXING UNIT FOR SHELL-TYPE IMAGE FORMATION APPARATUSES AND A PROCESS FOR THE PLACEMENT AND REMOVAL OF THE SAME

[75] Inventor: Tetsuro Tomoe, Osaka, Japan

[73] Assignee: Mita Industrial Co. Ltd., Osaka, Japan

[21] Appl. No.: 931,126

[22] Filed: Nov. 17, 1986

[30] Foreign Application Priority Data

Nov. 18, 1975 [JP] Japan ..... 60-177810

[51] Int. Cl.[4] ..... G03G 15/00

[52] U.S. Cl. ..... 355/3 FU; 355/14 FU; 219/216; 432/60

[58] Field of Search ..... 355/3 FU, 3 SH, 14 SH; 219/216, 269, 270; 432/60; 271/239, 240, 253, 254, 255

[56] References Cited

U.S. PATENT DOCUMENTS

| | | | |
|---|---|---|---|
| 4,188,109 | 2/1980 | Idenawa et al. | 355/3 FU |
| 4,384,781 | 5/1983 | Takada | 355/3 FU |
| 4,428,660 | 1/1984 | Matsumoto | 219/216 X |
| 4,589,758 | 5/1986 | Kasama et al. | 355/14 FU |

*Primary Examiner*—Patrick R. Salce
*Assistant Examiner*—Kristine Peckman
*Attorney, Agent, or Firm*—Spencer & Frank

[57] ABSTRACT

A fixing unit for shell-type image formation apparatuses comprising: a pair of fixing rollers, one of which is an upper roller contained in an upper housing and the other of which is a lower roller contained in a lower housing, said housings being pivotally held by a shaft that is parallel to said pair of fixing rollers, and a lever that can be rotated at the opening edge of said lower housing, said lever being rotated so that it holds the upper housing to the lower housing in its first position, and being able to be released from the first position so that it switches to the second position where it holds the lower housing to the body of the image formation apparatus in a prescribed position.

6 Claims, 4 Drawing Sheets

FIXING UNIT FOR SHELL-TYPE IMAGE FORMATION APPARATUSES AND A PROCESS FOR THE PLACEMENT AND REMOVAL OF THE SAME

BACKGROUND OF THE INVENTION

1. Field of the invention:

This invention relates to an improved fixing unit that is used for an image formation apparatus such as an electrophotographic copying machine, etc.

2. Description of the prior art:

In general, fixing units used for image formation apparatuses have a pair of rollers, one of which is an upper roller and the other of which is a lower roller. An upper housing containing the upper roller and a lower housing containing the lower roller are designed so that both housings can be rotated and opened and closed around a shaft, which is parallel to the pair of rollers. Conventionally, this lower housing is fixed by screws in a set position inside of the body of the image formation apparatus to thereby hold the fixing unit at a fixed place in the image formation apparatus. However, at times of inspection and so on, the fixing unit is taken out of the body of the image formation apparatus, and when it is again fixed into the body, even a small displacement in its position causes such problems as paper jams, arising from unsatisfactory operation of the fixing unit. In addition, placement of the fixing unit into the body of the image formation apparatus and removal of it as well are carried out from the front of the body of the apparatus, so that special coupling devices and sliding rails may be necessary. This makes the structure of both the body of the apparatus and the fixing unit, more complex and makes the miniaturization of the image formation apparatus and the fixing unit difficult.

On the other hand, in the space of the upper and lower rollers, the paper having an image thereon that enters may wrinkle, depending on the kind of paper used, which sometimes leads to failure in the step of fixation of the image. This is because a device to feed the paper between the rollers at the most appropriate angle has not yet been developed, notwithstanding the face that the most appropriate angle at which the paper should be introduced between the rollers depends on the kind of paper.

SUMMARY OF THE INVENTION

The fixing unit of this invention, which overcomes the above-discussed and numerous other disadvantages and deficiencies of the prior art, comprises a pair of fixing rollers, one of whichs an upper roller contained in an upper housing and the other of which is a lower roller contained in a lower housing, said housings being pivotally held by a shaft that is parallel to said pair of fixing rollers, and a lever than can be rotated at the opening edge of said lower housing, said lever being rotated so that it holds the upper housing to the lower housing in its first position, and being able to be released from the first position so that it switches to the second position where it holds the lower housing to the body of the image formation apparatus in a prescribed position.

In a preferred embodiment, the tip of said lever holds onto the opening edge of said upper housing, thereby attaining the placement of said lever in the first position where said upper housing is fixed in a lower position.

In a preferred embodiment, the fixing unit is held onto the base of the body of the image formation apparatus so as to engage said lower housing with said base by an engaging means; and said lever is rotated around its fulcrum to release it from said upper housing so that said lever can be released from the first position and can be engaged with said base by an engaging means, thereby attaining the placement of said lever in the second position.

In a preferred embodiment, the fixing unit further comprises a paper conveyance route positioned near the pair of fixing rollers, wherein said paper conveyance route is provided with an indentation in the center section thereby in the neighborhood of said rollers; the edge of said paper conveyance route is placed near the upper roller; and the edge of said indented central section is set near the boundary between the upper roller and the lower roller, whereby the angle at which paper is introduced into the space between the upper roller and the lower roller is changed depending upon the kind of paper.

The process for the placement and removal of said fixing unit of this invention, which overcomes the above-discussed and numerous other disadvantages and deficiencies of the prior art, comprises:

opening upwards the upper unit of said shelltype apparatus, placing said fixing unit on the base of the body of said apparatus in a prescribed position from the upward direction so as to engage said lower housing with said base by an engaging means in the state where a lever that can be rotated at the opening edge of said lower housing holds said upper housing to said lower housing in its first position, rotating said lever around its fulcrum to release it from the first position and to place it in the second position, where said lever is engaged with said base by an engaging means, thereby attaining the placement of said fixing unit into said apparatus, rotating said lever around its fulcrum to release it from the second position to thereby release it from said base and to place it in the first position to thereby hold said upper housing to said lower housing, and removing said fixing unit from said base of the body of said apparatus in the upward direction.

Thus, the invention described herein makes possible the objects of (1) providing a fixing unit that can be easily placed into and removed from an image formation apparatus of the shell type, the top unit of which is opened, and moreover that can be easily handled; (2) providing a fixing unit that can be placed into and removed from an image formation apparatus of the shell type in the upward direction with ease; (3) providing a fixing unit that when being put into the image formation apparatus, placement into the prescribed position can be easily and it can be placed there accurately and stably; (4) providing a fixing unit with a simple structure for insertion and removal by which the unit is placed into and removed from the image formation apparatus; (5) providing a fixing unit the exchange of which is easy; (6) providing a fixing unit with which miniaturization can be achieved; and (7) providing a fixing unit in which the angle of the introduction of the paper, into the space between the fixing rollers can be adjusted depending on the kind of paper used.

BRIEF DESCRIPTION OF THE DRAWINGS

This invention may be better understood and its numerous objects and advantages will become apparent to those skilled in the art by reference to the accompanying drawings as follows:

FIGS. 1(A) and 1(B) are side views showing a fixing unit for image formation apparatuses of this invention, wherein FIG. 1(A) shows the lever 33 in the first position and FIG. 1(B) shows the lever 33 in the second position.

DESCRIPTION OF THE PREFERRED EMBODIMENTS

Figure 1A:
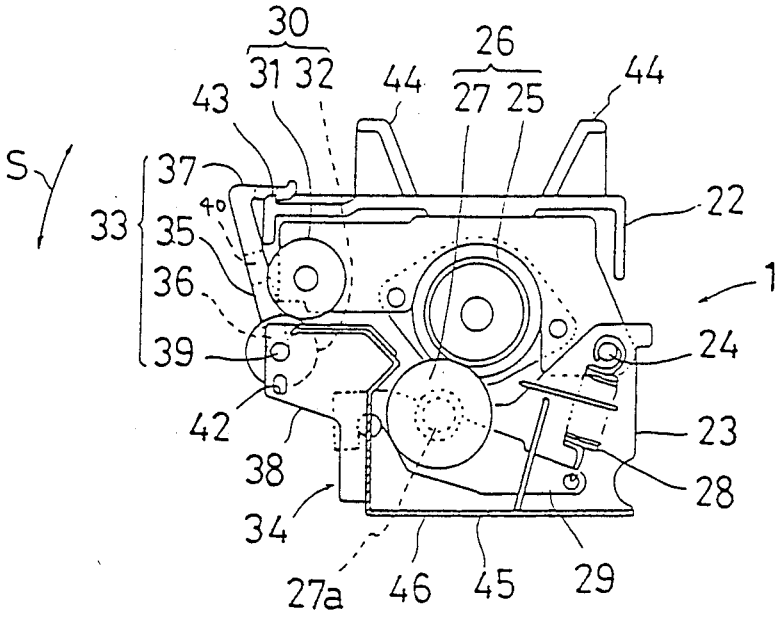
Figure 1B:
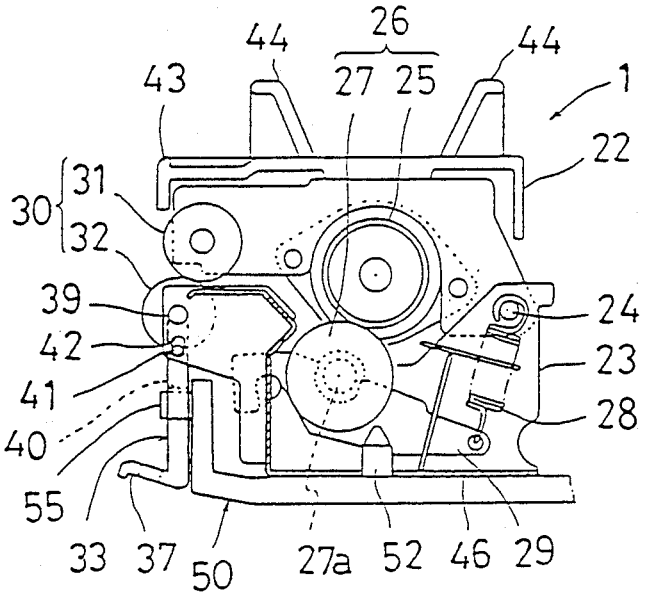
Figure 2:
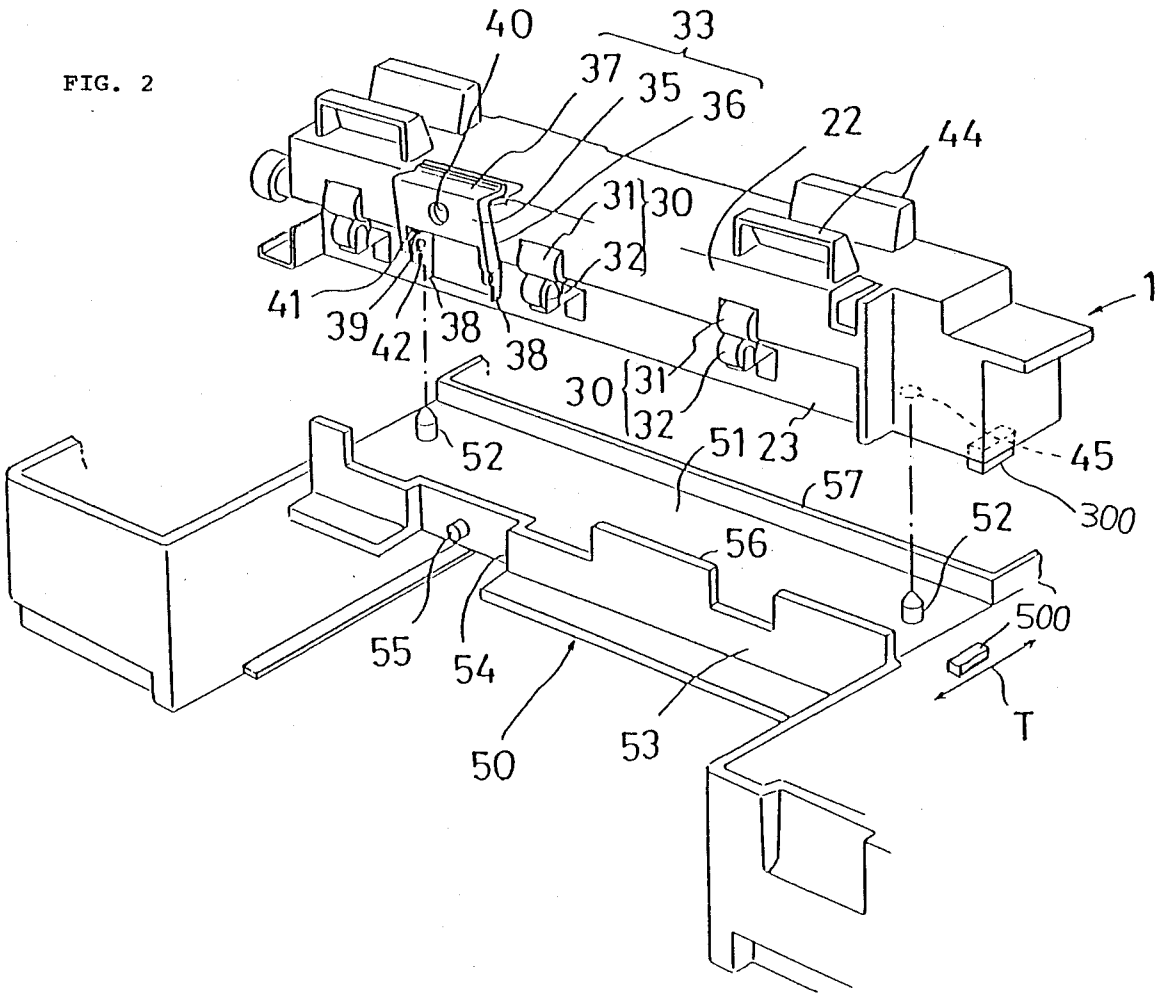
FIG. 2 is a perspective view showing a portion of the body of an image formation apparatus in which the fixing unit shown in FIG. 1(A) is held.
Figure 3:
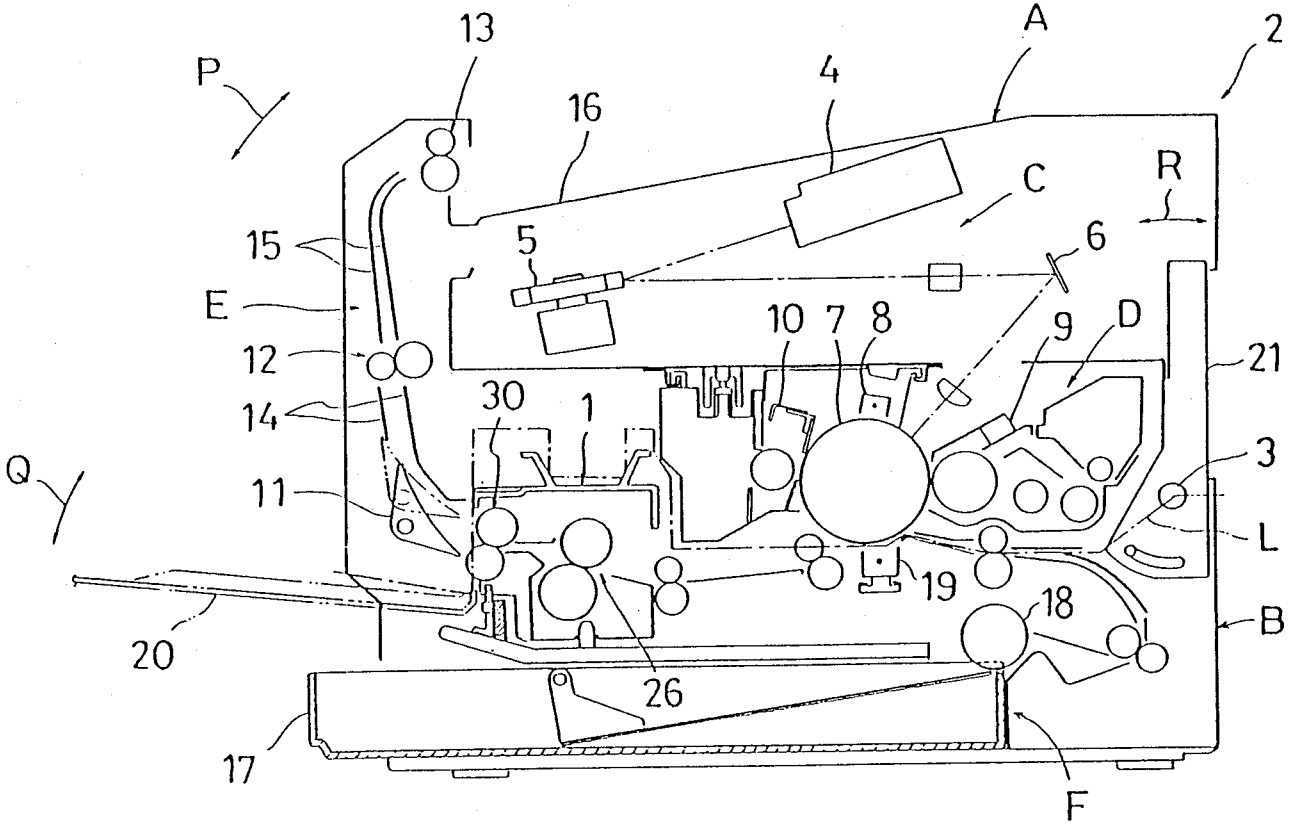
FIG. 3 is a sectional side view showing an image formation apparatus furnished with the fixing unit shown in FIG. 1(B).

FIGS. 1(A) and 1(B) show the fixing unit 1 for image formation apparatuses of the present invention. FIG. 1(A) shows the lever in the first position, and FIG. 1(B) the lever in the second position. FIG. 2 shows a portion of the body of the image formation apparatus in which the fixing unit is held. FIG. 3 shows an image formation apparatus 2 (for example, a laser printer) furnished with the fixing unit 1.

The image formation apparatus 2 has, as shown in FIG. 3, a clam-shell type of structure, comprising a top unit A and a bottom unit B. The top unit A rotates in the directions shown by arrow P around a shaft 3. The line L is an imaginary one that shows the line of division between the units A and B.

The inside of the upper unit A is provided with a laser optics unit C, an image-forming unit D, and an upper paper ejection unit E. The laser optics unit C has a laser generator 4 that receives signals from an image reading apparatus (not shown) and produces output corresponding to the signals, a rotating mirror 5, a reflecting mirror 6, etc. The image-forming unit D includes a photosensitive drum 7, and in the vicinity of the photosensitive drum 7, a charging means 8, a developing device 9, and a cleaning device 10. The upper paper ejection unit E has a means 11 for switching the paper-conveying route of the copying machine, a pair of rollers 12 and 13, guides 14 and 15, etc. Reference numeral 16 is the upper paper-ejection part.

The inside of the above-mentioned lower unit B has the fixing unit 1, a paper-supply unit F, and a transcribing means 19. The fixing unit 1 is provided in the vicinity of photosensitive drum 7. The fixing unit 1 is constructed so that when the upper unit A has been opened upward, it is placed on installation base 50 (FIG. 2) of the lower unit B from above and so that it can be lifted off of this installation base 50 upward. For that reason, there is no need for the provision of sliding rails or coupling devices on the installation base, as has been needed for conventional image formation apparatuses from which the fixing unit is removed from or returned to the apparatus from the front. Thus, the operations of installation and removal become much easier, as described later. The paper-supply unit F has a paper-supply cassette 17, paper-supply rollers 18, etc. Reference numeral 20 is the paper-ejection tray. This tray 20 can rotate in the directions shown by the arrow Q. Reference numeral 21 is the finger unit, which can rotate in the directions of arrow R around the above-mentioned shaft 3.

The structure of the fixing unit 1 and the installation of the fixing unit 1 into the image formation apparatus 2 will be explained below with reference to FIGS. 1(A) and 1(B) and FIG. 2.

Upper housing 22 and lower housing 23 pivot around a shaft 24 so that they can be opened and closed in the directions of arrow S. The inside of the upper housing 22 is provided with an upper roller 25 (a heating roller containing a heater) that is parallel to the shaft 24. The inside of the lower housing 23 is provided with a lower roller (a pressing roller) 27 that is parallel to the shaft 24. The upper roller 25 and the lower roller 27 constitute a pair of fixing rollers 26. The shaft 27*a* of the lower roller 27 is supported by the supporter 29, which is pressed to the upper roller 25 with a pulling spring 28. As a result, the lower roller 27 is held tight against the upper roller 25.

At the opposite side from the above-mentioned shaft 24 (that is, the opening ends of both housings 22 and 23), there are a pair of paper-ejection rollers 30. The roller 31, one of the pair of rollers 30, is included in the upper housing 22, and the other roller 32 is included in the lower housing 23.

A lever 33 is disposed at the open end of the lower housing 23 through a bracket 34 and is made of, for example, a synthetic resin. This lever 33 has a lever body 35, arms 36, and a stopper 37. The lever arms 36 are held by the bracket 34 by means of pins 39 passing through holes at the ends 38 of the bracket 34 and holes at the lever arms 36, so that the lever 33 can be freely rotated around the pins 39. A hole 40 is provided near the center of the lever body 35. This hole 40 can be engaged with a boss 55 of the installation base 50 as described below. The lever arms 36 extend from both sides of the lever body 35, and small protuberances 41 are disposed inside of those lever arms 36. By the engagement of the boss 55 of the installation base 50 with the hole 40 of the lever body 35 and the engagement of the above-mentioned protuberances 41 with long holes 42 of both sides 38 of the above-mentioned bracket 34, the lever 33 can be held in the second position.

The lever stopper 37 mentioned before is made so as to have an angle slightly less than 90° to the lever body 35. As shown in FIG. 1(A), when the lever 33 is in the first position, the lever 33 is engaged with the front edge 43 of the housing 22. There is a knob 44 in the upper part of upper housing 22.

As shown in FIG. 2, there are pins 52 spaced therebetween on the upper surface 52 of the installation base 50 of the lower unit B. At a part of the side wall 53 of the installation base 50, an indented part 54 in which the lever 33 fits is formed. This indented part 54 is provided with a nearly horizontal boss 55 that is fastened to the hole 40 of the lever body 35. There are guide plates 56 and 57 on the upper surface 51 of installation base 50, and these prevent the displacement of the fixing unit 1 in the direction of the arrow T. The fixing unit 1 is connected electrically to the lower unit B by means of the connectors 300 and 500.

When the fixing unit 1 is not yet placed on the installation base 50 of the image formation apparatus 2 (as during transportation), then, as shown in FIG. 1(A), the lever 33 is rotated in the upward direction and the stopper 37 is fixed to the front catch 43 of the upper housing 22, so that the lower housing 23 can be fastened to the upper housing 22.

When the fixing unit 1 is to be set at a prescribed position in the image formation apparatus 2, then, first of all, the upper unit A is rotated upward so as to open the apparatus. Then, the fixing unit 1, which is contained in the upper and the lower housings that have been fastened to each other by the lever 33 mentioned above, is placed onto the installation base 50 so that the pins 52 of the installation base 50 fit in the holes 45 of the bottom 46 of the lower housing 23. Thereafter, the lever 33 is rotated downward so as to release the apparatus from the above-mentioned fixed position (so that the housings 22 and 23 can revolve freely in the directions of arrow S, as shown in FIG. 1(A), around the shaft 24).

Then, lever 33 is rotated downward to engage the hole 40 of the lever body 35 with the boss 55 of the base 50, by which the lower housing 23 is fixed into the prescribed place on the installation base 50 and is stopped not only from movement in the directions shown by arrow T of FIG. 2, but also from displacement in the direction perpendicular to this.

Then, the upper unit A is rotated downward so that it returns to its original position (in place on the top of the lower unit B), and at the same time the upper housing 22 is pushed downward by the ends of upper unit A. Thus, the upper housing 22 and the lower housing 23 are coupled together as is necessary during the fixing process.

As mentioned above, in the prescribed situation with the fixing unit 1 on the installation base 50, the lever 33 is in the second position (FIG. 1(B)), so that paper having a fixed image thereon is not prevented from proceeding further in the downstream direction of paper conveyance from the pair of fixing rollers 26 and the pair of paper-ejection rollers 30. The fixed relationship between the lever 33 and the installation base 50 is not limited to that of the above example. For example, the lever 33 can be formed into an almost T-shape by extension of the stopper 37 in the opposite direction against the lever body 35, and the extended part can be fit in an indented part made on the lower part of the installation base 50.

Figure 4A:
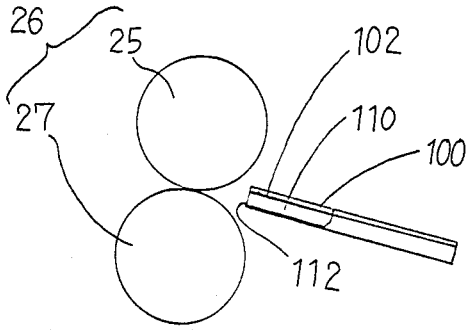
FIGS. 4(A) and 4(B), respectively, are a side view showing a pair of fixing rollers and a part of the conveying route near the fixing rollers and a perspective view showing the conveying route.
Figure 4B:
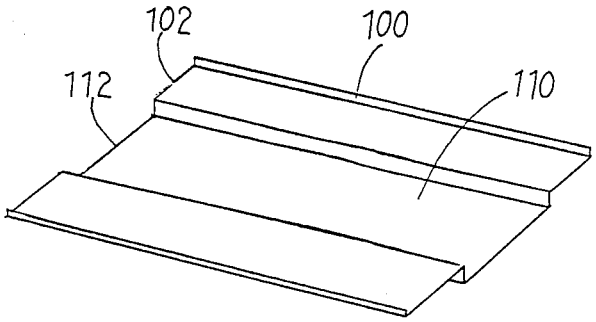

Moreover, the fixing unit 1 of the present invention can, as shown in FIGS. 4(A) and 4(B), change the angle at which the paper on which an image has been formed is introduced into the space between the upper roller 25 and the lower roller 27, depending upon the kind of paper, since there is an indentation in the center section 110 of the paper conveyance route 100 in the neighborhood of these rollers. The edges 102 of the paper conveyance route 100 are placed, for example, near the upper roller 25, and the edges 112 of the indented central section 110 are set, for example, near the boundary between the upper roller 25 and the lower roller 27. When copy paper, which is ordinarily relatively soft, is moved forward directly between the upper and the lower rollers, it is often wrinkled, but when the paper is directly touched by the upper roller 25 while passing through the paper conveyance route 100, wrinkling can be prevented. With postcards or other such stiff paper, conveyance may be stopped when the paper is touched by the upper roller 25 directly, but when the postcard is introduced between the two rollers through the indented central section 110, the postcard is conveyed smoothly, without wrinkling.

As mentioned above, the fixing unit of the present invention has a lever that can be freely rotated at the open end of the lower housing, said lever being rotated so that it holds the upper housing to the lower housing in its first position, and can be released from the first position so that it switches to the second position, where it holds the lower housing at the body of an image formation apparatus.

For that reason, when the fixing unit is removed from the body of the apparatus for inspection or some other reason, then when it is replaced into the body, it is possible to set the fixing unit into the body at a prescribed position with accuracy and stability. Moreover, the removal and replacement of the fixing unit is done above the image formation apparatus, so that the apparatus is only required to have a means for holding the fixing unit in the prescribed position. Thus, the process of removal and replacement of the fixing unit becomes easy and it is possible to miniaturize the apparatus.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A fixing unit, comprising:

a pair of fixing rollers, one of which is an upper roller contained in an upper housing, said upper housing having an opening edge, and the other of which is a lower roller contained in a lower housing, said lower housing having an opening edge, said housing being pivotally held by a shaft that is parallel to said pair of fixing rollers, and a lever that can be rotated at said opening edge of said lower housing, said lever being rotated so that it holds the upper housing to the lower housing in its first position, and being able to be released from the first position so that it switches to a second position where it holds the lower housing in a predetermined position.

2. A fixing unit according to claim 1, wherein the tip of said lever holds onto the opening edge of said upper housing, thereby attaining the placement of said lever in the first position where said upper housing is fixed in a low position.

3. A fixing unit according to claim 1, further comprising a base engaging means, wherein said fixing unit is adapted to be held onto a base of an image formation apparatus by said base engaging means so as to engage said lower housing with the base; and said lever being adapted to be rotated around its fulcrum to release it from said upper housing so that said lever can be released from the first position and can be engaged with said base by a lever engaging means, thereby attaining the placement of said lever in the second position.

4. A fixing unit according to claim 1, which further comprises a paper conveyance route positioned near the pair of fixing rollers, wherein said paper conveyance route is provided with an indentation in substantially a central section to provide an indented central section of said rollers; an edge of said paper conveyance route is placed near the upper roller; and an edge of said indented central section is set on a boundary between the upper roller and the lower roller, to provide an angle at which paper is introduced into a space between the upper roller and the lower roller, and said angle is capable of being changed depending upon the kind of paper.

5. A process for the placement and removal of a fixing unit for a shell-type image formation apparatus comprising a pair of fixing rollers, one of which is an upper roller contained in an upper housing to provide an upper unit, and the other of which is a lower roller contained in a lower housing, said housings being pivotally held by a shaft that is parallel to said pair of fixing rollers, said image formation apparatus having a body, said body having a base, wherein said process comprises:

opening upwards the upper unit of said shell-type apparatus, placing said fixing unit on engaging means of said base of said apparatus in a predetermined position so as to engage said lower housing with said base so that a lever can be rotated to an opening edge of said lower housing so that said lever holds said upper housing to said lower housing in its first position, rotating said lever around its fulcrum to release it from the first position and to place it in a second position, where said lever is engaged with a lever engaging means which is attached to said base, thereby attaining placement of said fixing unit into said apparatus, rotating said lever around its fulcrum to release it from the second position to thereby release it from said base and to place it in the first position to thereby hold said upper housing to said lower housing, and removing said fixing unit from said base of the body of said apparatus in the upward direction.

6. A fixing unit, comprising:

a pair of fixing rollers, one of which is an upper roller contained in an upper housing and the other of which is a lower roller contained in a lower housing, said lower housing having an opening edge, said housings being pivotally held by a shaft that is parallel to said pair of fixing rollers, and a lever that can be rotated at said opening edge of said lower housing, said lever being rotated so that it holds the upper housing to the lower housing in its first position, and be able to be released from the first position so that it switches to a second position where it holds the lower housing in a predetermined position, and said fixing unit further comprises a paper conveyance route positioned near the pair of fixing rollers, wherein said paper conveyance route is provided with an indentation in substantially a central section of said rollers to provide an indented central section; an edge of said paper conveyance route is placed near the upper roller; and an edge of said indented central section is set on a boundary between the upper roller and the lower roller, to provide an angle at which paper is introduced into a space between the upper roller and the lower roller, whereby said angle is capable of being changed depending upon the kind of paper.

* * * * *

UNITED STATES PATENT AND TRADEMARK OFFICE

CERTIFICATE OF CORRECTION

PATENT NO. : 4,782,359

DATED : November 1, 1988

INVENTOR(S) : Tetsuro Tomoe

It is certified that error appears in the above-identified patent and that said Letters Patent is hereby corrected as shown below:

In the heading, item [30] should read:

[30] Foreign Application Priority Data

November 18, 1985 [JP] Japan ..... 60-177810

Signed and Sealed this

Seventh Day of March, 1989

*Attest:*

DONALD J. QUIGG

*Attesting Officer*

*Commissioner of Patents and Trademarks*